US010353320B2

(12) United States Patent
Nelson et al.

(10) Patent No.: US 10,353,320 B2
(45) Date of Patent: Jul. 16, 2019

(54) CONTROLLING INK DEVELOPER VOLTAGES

(71) Applicant: HP INDIGO B.V., Amstelveen (NL)

(72) Inventors: Eric G. Nelson, Eagle, ID (US); Yoav Nachmias, Ness Ziona (IL); Michel Assenheimer, Kfar Sava (IL); Vitaly Portnoy, Ness Ziona (IL); Amiran Lavon, Bat Yam (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/752,861

(22) PCT Filed: Aug. 19, 2015

(86) PCT No.: PCT/US2015/045916

§ 371 (c)(1),
(2) Date: Feb. 14, 2018

(87) PCT Pub. No.: WO2017/030580

PCT Pub. Date: Feb. 23, 2017

(65) Prior Publication Data

US 2018/0231922 A1 Aug. 16, 2018

(51) Int. Cl.
*G03G 15/06* (2006.01)
*G03G 15/11* (2006.01)
(Continued)

(52) U.S. Cl.
CPC ..... *G03G 15/11* (2013.01); *G03G 9/122* (2013.01); *G03G 9/13* (2013.01); *G03G 9/16* (2013.01);
(Continued)

(58) Field of Classification Search
CPC ..... G03G 9/122; G03G 9/13; G03G 9/16; G03G 15/11; G03G 15/50; G03G 21/0088;
(Continued)

(56) References Cited

U.S. PATENT DOCUMENTS 5,066,988 A 11/1991 Miyake
6,067,427 A 5/2000 Shin
(Continued)

FOREIGN PATENT DOCUMENTS

EP 1429205 6/2004
JP 09326928 12/1997
(Continued)

OTHER PUBLICATIONS

Bartolic, T. et al., "Impact of Printing Additional Inks on Multicolor Reproduction in Liquid Toner Electrophotography," International Conference on Materials, Tribology, Recycling, Jun. 27-29, 2013.
(Continued)

*Primary Examiner* — Hoang X Ngo
(74) *Attorney, Agent, or Firm* — Fabian VanCott

(57) ABSTRACT

Example implementations provide a method of controlling an ink developer used in electro-photography; the method comprising, following cessation of printing, varying a plurality of voltages associated with movement of ink within the ink developer at temporally disparate times.

13 Claims, 11 Drawing Sheets

(51) Int. Cl.

| | |
|---|---|
| ***G03G 9/12*** | (2006.01) |
| ***G03G 9/13*** | (2006.01) |
| ***G03G 9/16*** | (2006.01) |
| ***G03G 21/00*** | (2006.01) |
| *G03G 15/00* | (2006.01) |

(52) U.S. Cl.
CPC ..... *G03G 21/0088* (2013.01); *G03G 15/065* (2013.01); *G03G 15/50* (2013.01); *G03G 2215/0629* (2013.01); *G03G 2215/0658* (2013.01)

(58) Field of Classification Search
CPC ... G03G 2215/0629; G03G 2215/0658; G03G 15/065
See application file for complete search history.

(56) References Cited

U.S. PATENT DOCUMENTS

| | | | |
|---|---|---|---|
| 7,400,850 | B2 | 7/2008 | Romem |
| 7,421,223 | B2 | 9/2008 | Jodra et al. |
| 7,668,488 | B2 | 2/2010 | Guzman et al. |
| 7,792,444 | B2 | 9/2010 | Raz et al. |
| 8,290,404 | B2 | 10/2012 | Raz |
| 8,301,045 | B2 | 10/2012 | Ohshika |
| 8,991,313 | B2 | 3/2015 | Lopez et al. |
| 9,037,048 | B2 | 5/2015 | Berg et al. |
| 2001/0026713 | A1 | 10/2001 | Nishikawa |
| 2002/0057933 | A1 | 5/2002 | Ebihara et al. |
| 2007/0019996 | A1 | 1/2007 | Romem |
| 2010/0111552 | A1 | 5/2010 | Shiraki et al. |
| 2010/0296825 | A1 | 11/2010 | Kella et al. |
| 2011/0217082 | A1 | 9/2011 | Frydman et al. |
| 2011/0274452 | A1 | 11/2011 | Fukuyama et al. |
| 2012/0201555 | A1* | 8/2012 | Nishiyama ..... G03G 15/104 399/55 |
| 2014/0119758 | A1 | 5/2014 | Lee et al. |
| 2015/0071665 | A1 | 3/2015 | Lam et al. |
| 2015/0098717 | A1 | 4/2015 | Park et al. |

FOREIGN PATENT DOCUMENTS

| | | |
|---|---|---|
| JP | 2000199996 | 7/2000 |
| JP | 2006154543 | 6/2006 |
| JP | 5439362 | 3/2014 |

OTHER PUBLICATIONS

Anthony, Thomas C., et al. "ElectroInk Charge Retention in the HP Indigo LEP Press." NIP & Digital Fabrication Conference. vol. 2012. No. 2. Society for Imaging Science and Technology, 2012.

* cited by examiner

200

400A

400B

400C

400E

600

700

CONTROLLING INK DEVELOPER VOLTAGES

Electro-photography printing forms an image on a substrate by selectively charging or discharging a photoconductive drum with an image to be printed. A colourant is applied to the charged drum and subsequently transferred to the substrate.

Liquid electro-photography (LEP) uses inks as the colourants, as opposed to, for example, a toner. An LEP printing device comprises a binary ink developer (BID) that applies the ink to a development roller (DR) that, in turn, applies the ink to a Photo Imaging Plate (PIP).

In between each duty cycle, LEP printing devices are cleaned with a view to maintaining a high image quality unadulterated by previous printing cycles. Ineffective cleaning can adversely affect print quality.

BRIEF DESCRIPTION OF THE DRAWINGS

Various implementations are described, by way of example, with reference to the accompanying drawings, in which.

DETAILED DESCRIPTION

Figure 1:
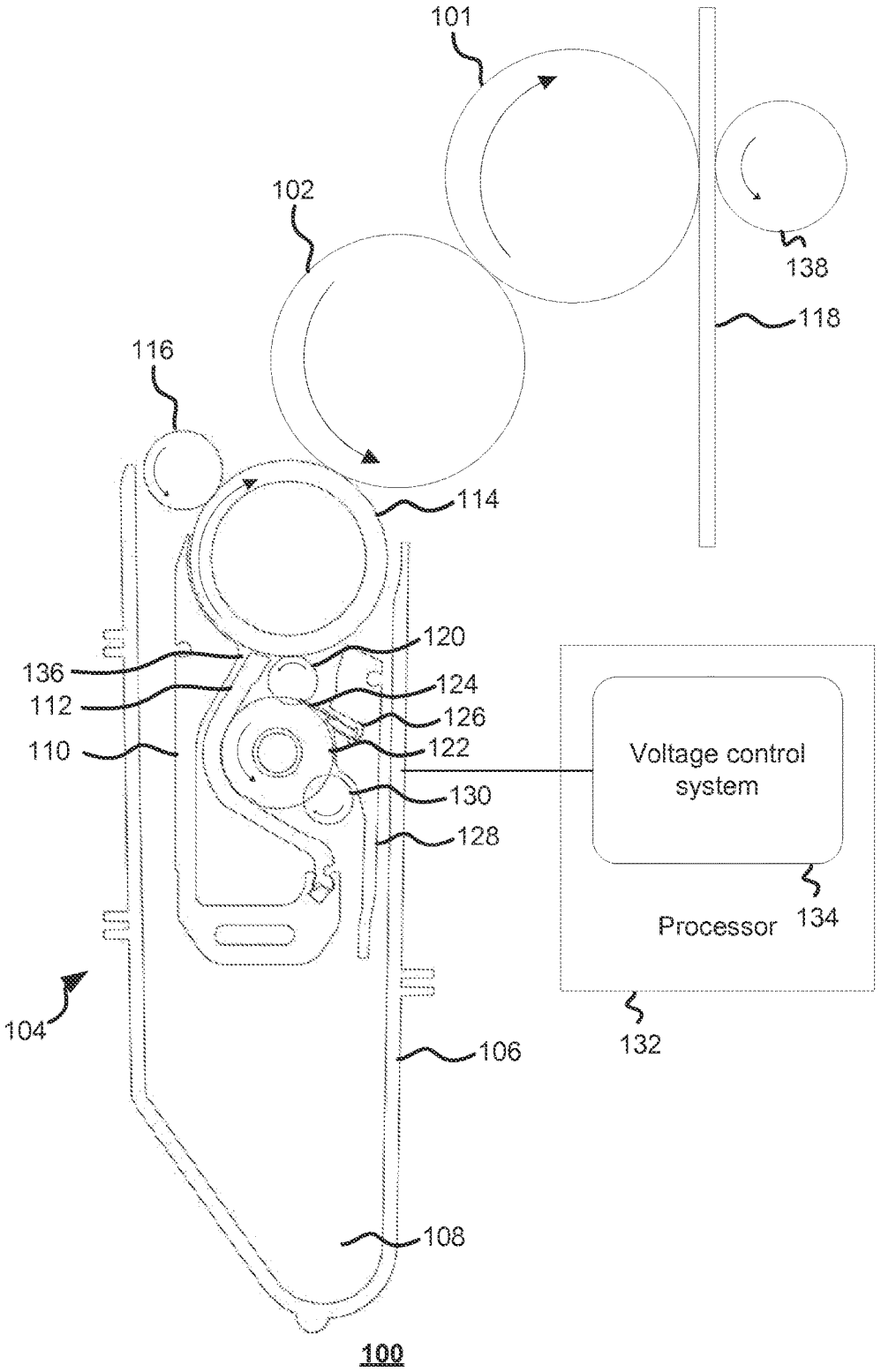
FIG. 1 shows an LEP device according to an example implementation.

Referring to FIG. 1, there is shown a view of a liquid electro-photography printing device 100 according to an example implementation. The LEP printing device 100 comprises an Intermediate Transfer member ITM or blanket drum 101, a photoconductive drum, that is, a Photo Imaging Plate (PIP) 102, and a developer, which can be a binary ink developer (BID) 104.

The BID 104 of the LEP printing device 100 comprises a housing 106. The housing 106 defines an ink tray 108 that collects unused ink of any ink that was not used in forming an image on a medium 118. The ink is a combination of liquid and solid, such as 98% liquid and 2% solid in one example implementation. The liquid may be an oil or another type of liquid. The solid may be a pigment or another type of solid. Both the liquid and solid components can contain a number of compounds. The solid can comprise a number of wax resins together with a pigment in addition to other compounds. Similarly, the liquid carrier can be a dielectric oils. The oil can comprise a number of oils of different molecular weights as well as a number of dissolved materials such as, for example, charge active agents, stabilization compounds amongst others. During printing, ink is pumped from a tank (not shown) for use in printing and collected in ink tray 108 after printing from which it drains into the tank.

The BID 104 comprises primary 110 and secondary 112 electrodes. The primary and secondary electrodes 110 and 112 may be held at respective predetermined voltages such as, for example, a negative electrical potential, to influence ink movement to a development roller (DR) 114. The negative potential can be, for example, −1500 volts, but could be some other suitable potential. The state of the ink can be varied, that is, developed at least partially or fully. When the ink is in a state where it is more liquid than solid, the ink can migrate from the primary and secondary electrodes 110 and 112 to coat the developer roller 114 of the BID 104. The developer roller 114 is held at a respective predetermined electrical potential. The DR 114 electrical potential can be less negative than the primary electrode 110. Example implementations can be realised in which the DR is held at, for example, −450 volts, but could be some other suitable voltage. The DR 114 can be rotated clockwise as indicated by the associated arrow.

The BID 104 includes a squeegee roller (SQ) 116 that rotates in the opposite direction to the developer roller 114. The SQ roller 116 is at a predetermined SQ potential. Example implementations can be realised in which the SQ potential is more negative than the developer roller 114. For example, the SQ roller can be operated at −750 volts, but could be some other suitable voltage. The squeegee roller 116 skims the ink that has been coated onto the developer roller 114 to influence its composition, in particular, its viscosity. Following skimming, the ink can be more solid than liquid. For instance, after skimming by the squeegee roller 116, the ink coated on the developer roller 114 may be 20% solid and 80% liquid.

After skimming, the ink remaining on the developer roller 114 is selectively transferred to the PIP 102. The PIP 102 can rotate in the opposite direction to the developer roller 114. In operation, the PIP 102 will have been previously uniformly charged and, in response to an image to be printed or otherwise formed on the medium 118, selectively discharged by selective writing by laser light. The ink on the developer roller 114 is transferred to the PIP 102 only where the PIP 102 has been selectively discharged in areas intended to form an image; the PIP 102 having been previously charged. Thereafter, the PIP 102 makes contact with the ITM 101, which, in turn, makes contact with the medium 118 to transfer the ink to the medium 118. Therefore, a desired image is formed on the medium 118. The ITM 101 and PIP 102 rotate as indicated in FIG. 1.

Ink that is not transferred from the developer roller 114 to the PIP 102 is referred to as unused ink. The BID 104 comprises a cleaner roller (CL) 120. The cleaner roller can rotate as indicated in FIG. 1. The cleaner roller 120 can be held at a predetermined potential. Example implementations can be realised in which the CL predetermined potential is less negative than that of the developer roller 114. For example, the CL predetermined potential can be −250 volts, but can be some other suitable voltage. The cleaner roller 120 cleans the unused ink from the developer roller 114. Example implementations can be realised in the cleaner voltage is adaptable with time. For example, the cleaner voltage can vary with BID age, resistivity or some other parameter.

The BID 104 can further comprise a sponge roller 122. The sponge roller 122 can rotate in the same direction as the cleaner roller 120. The sponge roller 122 comprises a sponge bearing a number of open cells or pores. Example implementations can be produced in which the sponge roller 122 can comprise an open-cell material such as, for example, polyurethane foam. The sponge roller 122 is resiliently compressible and is compressed by one of the secondary electrode 112, the cleaner roller 120 and a squeezer roller 130 of the BID 104, taken jointly and severally in any and all permutations.

The sponge roller 122 also cooperates with a wiper blade 124 to recover unused ink from the DR 114, that is, any unused ink remaining on the cleaner roller 120 that is not removed by the sponge roller 122 is scraped from the cleaner roller 120 onto the sponge roller 122 by the wiper blade 124. The wiper blade 124 is part of a wiper mechanism 126 of the BID 104. The wiper mechanism 126 comprises a wiper back wall 128 to direct recovered ink into the tray 108. Ink flowing between the secondary electrode 112 and the developer roller 114 to the sponge roller 122 is remixed by the sponge roller 122 and the secondary electrode 112 with unused ink to return the unused ink to its former state.

The squeezer roller 130 recovers the unused ink that has been absorbed by the sponge roller 122 for reuse. Therefore, the unused ink released from the sponge roller 122 by the squeezer roller 130 returns to the ink tray 108 and drains into a tank (not shown). Example implementations can be realised in which the sponge roller 122 is also operable to disperse or otherwise break up solid parts of the unused ink. Prior to recovery, unused ink acts more solid than liquid. The squeezer roller 130 releases the unused ink from the sponge roller 122 by compressing the sponge roller 122, that is, the squeezer roller 130 is urged against or otherwise resiliently compresses the sponge roller 122 to release the unused ink from the sponge roller 122. Example implementations can be realised that do not use a squeezer roller 130.

Also shown in FIG. 1 is a processor 132 to execute executable code 134 for controlling the overall operation of the rollers during printing. The executable code 134 comprises instructions arranged, when executed by the processor 132, to control applying voltages to the rollers and electrodes during BID operation such as, for example, during a printing cycle. After printing, example implementations can apply different voltages to the electrodes and rollers during a cleaning cycle. Example implementations are provided in which the different voltages are temporally offset relative to one another, or relative to at least one other voltage. Example implementations can be realised in which the temporally offset voltages comprise transitions that are not temporally aligned. The transitions are temporally disparate.

The processor can also control the various motors that are used to rotate the various rollers of the BID 104. Additionally, the processor can also control mechanisms for engaging and disengaging the BID.

During a printing cycle, the BID 104 performs several functions comprising developing ink, applying ink to the PIP and removing residual ink. Ink flows from the ink tank through an aperture 136, between the two arms of the electrodes 110 and 112, to the DR 114. The DR 114 applies the ink to the PIP 102. The ink is then transferred by the ITM 101 to the medium 118, with the assistance of an impression roller 138. After a printing cycle, the cleaner roller 120 recovers ink remnants, that is, unused ink, from the developer roller 114.

The above operations are performed under the control of the executable code 134. The executable code drives motors (not shown) to control the speed and timing of rotation of the rollers as well as the voltages applied to the rollers and electrodes for electrostatically cleaning the rollers, at least for electrostatically cleaning the developer roller 114, as well as for ink development. Example implementations can be realised in which the electrode voltages control the thickness of a deposited ink layer and the developer roller 114 voltage controls the solid optical density of the ink. The CL roller 120 voltage and the squeegee roller 116 voltage are set relative to the DR 114 voltage. The foregoing voltages are selected, applied and varied according to the ink to be deposited.

FIG. 1 shows a single BID 104. However, example implementations will use as many BIDs 104 as are appropriate to a colour system used by a printing device. For example, a four colour process, involving yellow, magenta, cyan and black, uses four BIDs. Similarly, a six colour process, such as, for example, Pantone's hexachrome system, would use six BIDs. Suitably, example implementations of printing devices can be realised that use a plurality of BIDs. At least one BID of the plurality of BIDs is operable according to example implementations described herein.

Figure 2:
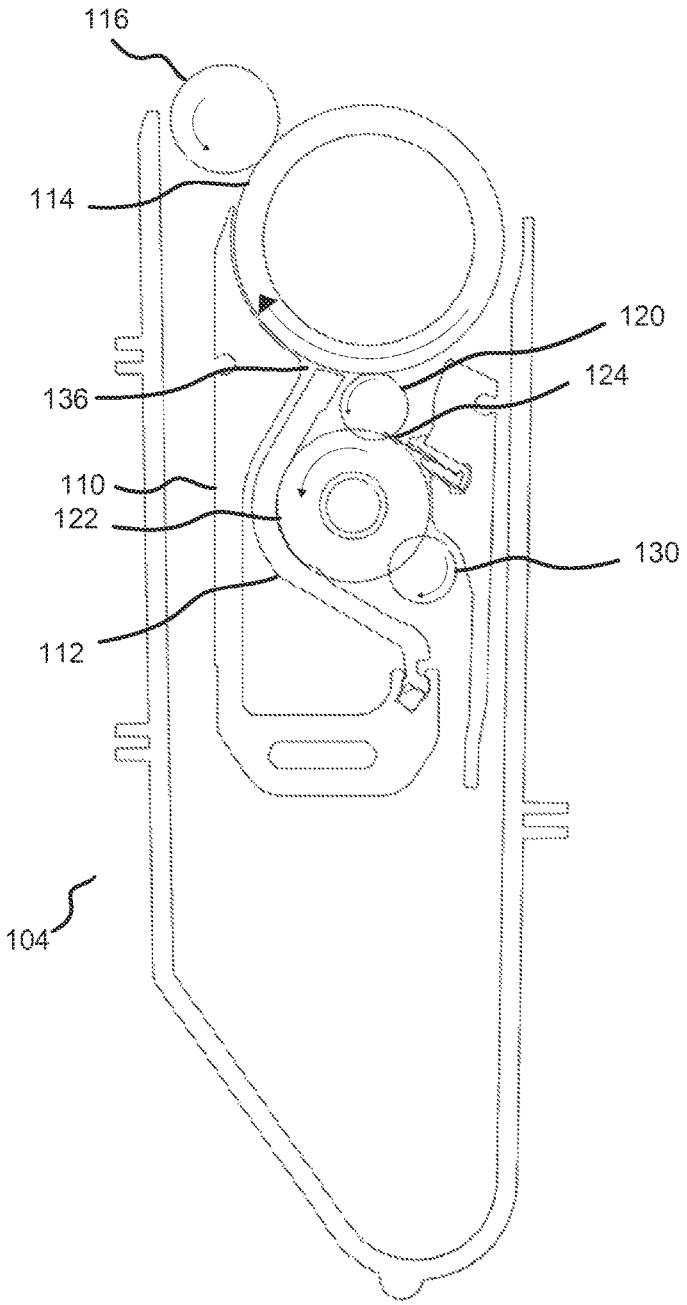
FIG. 2 depicts the LEP BID according to the example implementation.

Referring to FIG. 2, there is shown a closer view 200 of the binary ink developer 104. Operations of the example implementations will be described with reference to four colour process printing, which will use four BIDs. Each of the four BIDs has respective control voltages. The BIDs are applied separately. Each BID has a consistent duty cycle comprising a plurality of steps. The duty cycle can comprise preparing the voltages for ink development in advance of the BID 104 engaging the PIP 102, printing the separation, that is, applying the ink to the PIP 102 and then cleaning the BID 104 following separation. The duty cycle can comprise a plurality of phases. The plurality of phases can comprise a preparation phase, a printing phase or a cleaning phase. The respective preparation, printing and cleaning phases of one ink developer can run in parallel with respective preparation, printing and cleaning phases of another ink developer, but for simultaneous printing phases, which is not allowed. Example implementations in this specification refer to cessation of printing, which can comprise or represent an end of ink development of one process. However, printing of an image can comprise multiple ink development instances, at least one for each colour in a multi-colour process. Therefore, printing associated with an example implementation of an ink developer can terminate while printing associated with different ink developer starts as part of an overall process of printing an image. Therefore, cessation of printing can be synonymous with printing by a given ink developer as opposed to, or in addition to, printing by all developers terminating.

The preparation phase commences a predetermined period of time in advance of the separation. The predetermined period of time influences print quality. Example implementations are provided in which the predetermined period of time is sufficient for an applied voltage to stabilise sufficiently to achieve a desired print quality. Example implementations can be realised in which the preparation has a duration of at least 139 ms from initial turn-on in preparation for printing an image, including allowing the voltages to stabilise.

The separation, that is, printing phase, spans a respective predetermined period of time. Example implementations are provided in which the predetermined period of time is 211 ms, which is the time taken to print the image Following the printing phase, the cleaning phase spans a predetermined period of time. Example implementations are provided in which the cleaning phase spans 68 ms, which is the time from the end of printing the image to the voltages, discussed with reference to FIG. 3, being zero.

During printing, the BID is engaged, that is, sufficiently proximate to the PIP 102, for printing to take place. Once printing has finished, the BID is disengaged, that is, the BID is moved distally to a distal position relative to the BID's proximal printing position. Known cleaning phases are such that when printing has finished, the BID is disengaged and the voltages applied to the various rollers and electrodes are set to zero. The result is that ink development is terminated. However, the ink residing on the DR is still partially or fully developed. It takes about 30 ms for the developed ink to clear, that is, for the ink to pass the BID 104 to PIP 102 contact point and about 60 ms for all developed ink to pass the cleaner roller 120.

In contrast, example implementations are provided in which electrostatic cleaning of the developer roller 114 takes place while applied voltages are maintained as described hereafter. Advantageously, because the BID is disengaged before the applied voltage is turned off, ink remnants are not transferred to the PIP, but rather stay on the DR 114 until cleaned off.

Furthermore, a known BID problem is that ink may adhere to the DR 114, which creates a non-conductive non-uniform thin layer that, in turn, leads to the appearance of stains in an image, or that can adversely influence and even prevent ink flow into and from the electrodes, which creates streaks. Suitably, example implementations are provided in which the voltages applied to the plurality of rollers and electrodes are progressively varied during a cleaning phase. Not turning off all voltages substantially simultaneously, as per the prior art, results in a progressive or gradual sequence of reducing the applied voltages according to respective voltage profiles. Such voltage profiles for the applied voltages results in improved cleaning phases. The voltage profiles are such that the applied voltages are varied in a temporally disparate manner. Example implementations of such a temporally disparate manner will be described with reference to FIGS. 4 to 6 and contrasted with turn-off voltages of the prior art shown in FIG. 3.

Figure 3:
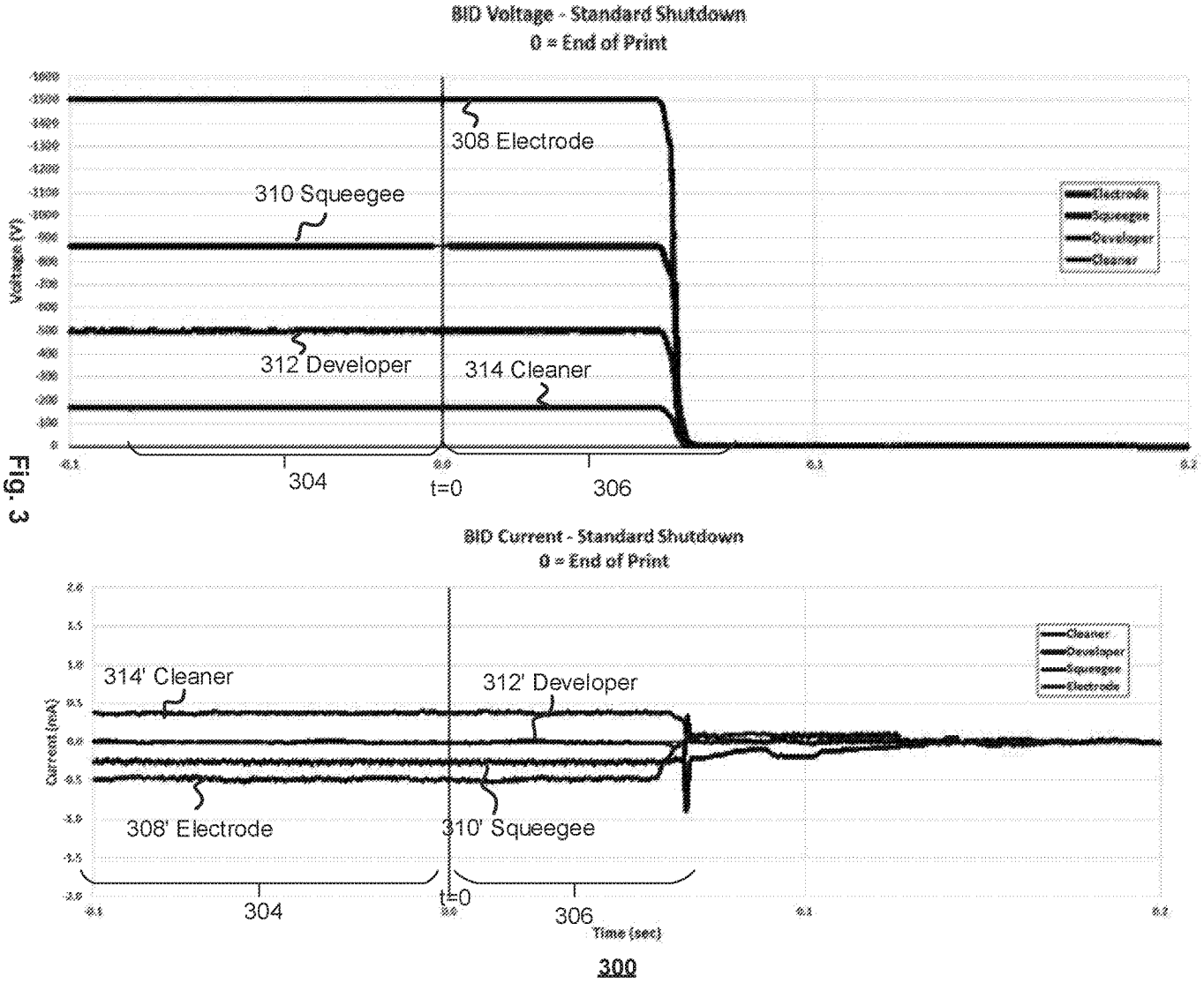
FIG. 3 illustrates prior art shut-down voltages and currents for controlling a BID.

FIG. 3 shows a chart 300 of known BID shut-down voltages and currents. The applied voltages have distinct phases, which can comprise the above-mentioned preparation phase, printing phase and cleaning phase of which only the printing phase 304 and cleaning phase 306 are shown.

During the preparation phase (not shown), a plurality of voltages is established and allowed time to stabilize. In the example implementation illustrated, the voltages comprise primary and secondary electrode voltages 308, a squeegee roller voltage 310, a developer roller voltage 312 or a cleaner roller voltage 314 taken jointly and severally in any and all permutations.

During the printing phase 304, stable predetermined voltages are maintained while printing takes place. The electrode voltage 308 is shown as being −1500V. The squeegee roller voltage 310 is shown as being approximately −875V. The developer roller voltage 312 is shown as being −500V and the cleaner roller voltage 314 is shown as being approximately −+175V.

During the cleaning phase 306, all voltages are reduced to zero after printing terminates at time t=0.

Once the voltages have been reduced to zero, mechanical cleaning commences. The excess or unused ink is cleared from at least the PIP 102 in a predeterminable number of revolutions.

The lower chart shows the corresponding variations in currents during the above phases 304 to 306. An electrode current 308' is associated with the electrode voltage 308. A squeegee roller current 310' is associated with the squeegee roller voltage 310. A developer roller current 312' is associated with the developer roller voltage 312. A cleaner roller current 314' is associated with the cleaner roller voltage 314.

It will be noted that the various currents continue to flow well beyond the time at which the voltages have been shut-down. This follows from at least the developer roller still bearing developed ink.

Figure 4A:
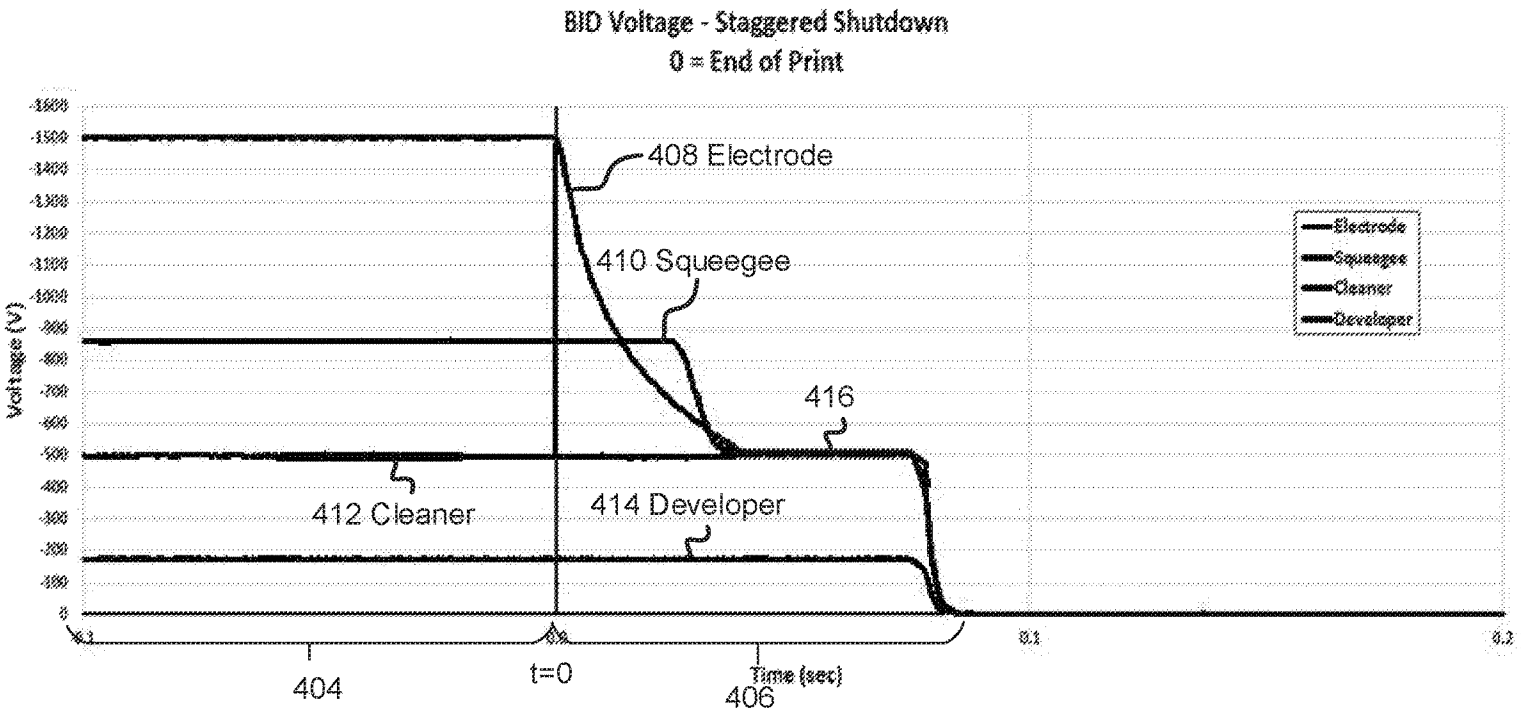
FIGS. 4A to 4E show voltage profiles for controlling a BID and respective currents according to example implementations.

FIG. 4A shows a chart 400A of BID voltages according to an example implementation. The applied voltages have distinct phases; namely, a preparation phase (not shown), a printing phase 404 and a cleaning phase 406.

During the preparation phase (not shown), a plurality of voltages is established and allowed time to stabilize. The voltages can comprise primary and secondary electrode voltages 408, a squeegee roller voltage 410, a developer roller voltage 412 and a cleaner roller voltage 414.

During the printing phase 404, stable predetermined voltages are maintained while printing takes place. A predetermined electrode voltage 408 is shown as being, for example, −1500V. A predetermined squeegee roller voltage 410 is shown as being, for example, approximately −875V. A predetermined developer roller voltage 412 is shown as being, for example, −500V and a predetermined cleaner roller voltage 414 is shown as being, for example, approximately −175V. Although specific electrode and roller voltages have been given about, example implementations are not limited to those precise voltages. Example implementations can be realised that use different electrode and roller voltages. The different voltages can be influenced by, for example, the characteristics of the ink used during printing or desired printing properties. Example implementations are provided in which the printing phase 404 spans a predetermined period of time. Example implementations can be realised in which the predetermined period of time is 211 ms.

A voltage of the plurality of voltages 408 to 414 has a predetermined respective voltage profile, which is in contrast to the common single step of the voltages shown in FIG. 3. In the example implementation illustrated, at least two voltages of the plurality of voltages have respective voltage profiles. In the example implementation shown, two or more of the predetermined respective profiles are different. The transitions of the voltages from their levels during printing to their ultimate off levels are at least one of temporally separated and, in some instances, non-linear. Example implementations can be realised in which the respective voltage profiles are known as post-printing voltage profiles or cleaning voltage profiles.

Referring to the electrode voltage 408, the respective voltage profile, following the end of printing at time t=0, comprises a nonlinear decay over a corresponding period of time. Example implementations can be realised in which the decay in voltage represents an example implementation of a transition from the electrode voltage during printing to a predetermined voltage such as, for example, a further stable voltage. In the example implementation shown, the electrode voltage transition involves a change from the printing voltage to a stable voltage such as, for example, a voltage that influences ink movement to the developer roller, such as terminating ink movement to the developer roller. Alternatively, or additionally, example implementations can be realised in which the electrode voltage decays from the printing voltage to a stable voltage such as, for example, voltage that influences the development of the ink, such as reducing or terminating ink development. The foregoing can be achieved, at least in part, by arranging for the electrode voltage to decay to a predetermined level such as, for example, a level that matches the developer roller voltage 412, that is, the potential difference between the electrode and at least one other voltage, such as, for example, the developer roller is varied. The at least one other voltage can be one voltage of a plurality of voltages. However, example implementations can be realised that reduce the potential difference to a predetermined voltage such as, for example, 15V.

Referring to the squeegee roller voltage 410, it has a respective voltage profile following cessation of printing. The squeegee roller voltage profile is a multi-step profile that is reduced from a first voltage such as, for example, the printing voltage, that is, from the voltage value during the printing phase 404, to an intermediate predetermined value for a respective period of time and then to a final predetermined value. Example implementations can be realised in which the intermediate predetermined value is a voltage that influences the development of ink such as, for example, reducing or terminating ink development. Example implementations can be realised in which the intermediate predetermined squeegee roller voltage is adjusted to a predetermined level such as, for example, a predetermined voltage from the developer roller voltage such as, for example, 15V, which would give an intermediate predetermined squeegee voltage of −515V. The voltage profile of the squeegee roller voltage comprises a plateau. Therefore, it can be seen that maintaining the squeegee roller bias relative to at least one other voltage, such as, for example, the developer roller is followed by reducing the squeegee roller bias relative to the developer roller.

Example implementations can be realised in which the squeegee roller voltage 410 is maintained at a higher level relative to the electrode voltage 408. Maintaining the higher voltage level relative to the electrode 408 prevents partially developed ink from transferring to the squeegee roller due to its position relative to the electrodes. Alternatively or additionally, arranging for the electrode voltage to reach a shut-down voltage first prevents moving partially developed ink to the squeegee roller. The higher level is, according to example implementations, the same as the squeegee roller voltage during printing, but could be some other value. Example implementations can, additionally or alternatively, be realised that maintain the squeegee roller voltage 410 above the developer roller voltage to reduce or prevent transfer of ink from the developer roller to the squeegee roller. Therefore, example implementations can vary the squeegee voltage according to a respective predeterminable voltage profile.

Referring to the developer roller voltage 412, it has a single step profile that takes the developer roller voltage from the printing voltage to a final value. Example implementations are provided in which the final value is 0V. While there is still ink on the developer roller, cleaning between the developer roller and the cleaner roller continues until all developed ink has been electrostatically cleaned. The single step down in the developer roller voltage 412 to the final value occurs a predetermined period of time after the cessation of printing at time t=0. Example implementations are provided in which the cleaning phase spans a predetermined period of time. Example implementations can be realised in which the predetermined period of time is 84 ms.

The squeegee roller voltage 410 and the electrode voltage 408 can be matched to the developer roller voltage to influence ink development. Example implementations can be realised in which ink development is stopped by arranging for the squeegee roller voltage and the electrode voltages to match the developer roller voltage 412.

The squeegee roller voltage step down is arranged to occur a predetermined period of time after time t=0. Example implementations can be realised in which the predetermined period of time is 25 ms. Further example implementations can be additionally or alternatively realised in which the squeegee roller voltage 410 is stepped down once the electrode voltage 408 is less than the squeegee roller voltage.

Referring to the cleaner roller voltage 414, it has a single step profile that takes the cleaner roller voltage from the printing voltage, that is, from a value held during the printing phase, to a final value. Example implementations are provided in which the final value is 0V. The single step down in the cleaner roller voltage 414 to the final value occurs a predetermined period of time after the cessation of printing at time t=0.

Following cessation of printing, maintaining a cleaner roller bias relative to the developer roller removes ink from the developer roller concurrently with varying at least one of the electrode bias and the squeegee roller bias relative to the developer roller influences ink movement associated with the developer roller and at least one of the electrode and squeegee roller. Example implementations are provided in which the electrode bias is reduced relative to the developer roller voltage to prevent ink movement to the developer roller. Still further, reducing the electrode bias relative to the developer roller comprises reducing the electrode bias relative to the developer roller to prevent ink movement to the developer roller. The above plurality of voltages, or at least a subset thereof, can be changed to off voltages such as, for example, 0v.

Figure 4B:
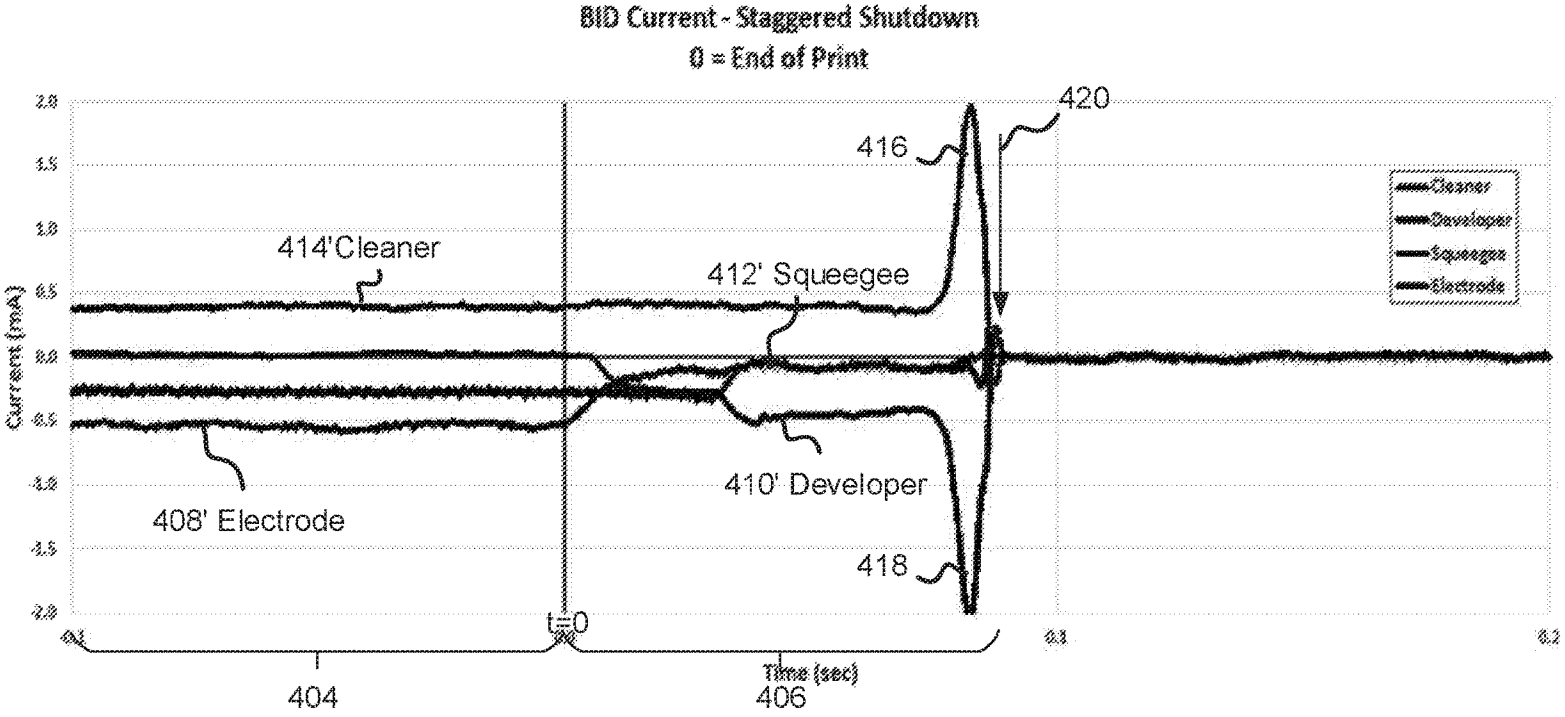

Referring to FIG. 4B, there is shown a chart 400B showing the associated shut-down currents, two noticeable differences as compared to the corresponding prior art chart shown in FIG. 3 can be observed. A first difference is that the cleaner roller current 414' exhibits a large current spike 416. The current spike 416 arises a predetermined period of time following the cessation of printing at time t=0, which follows from there being a reduction in resistivity associated with, or between, the cleaner roller 120 and the developer current roller 114 such as, for example, an absence of ink between the two rollers 120 and 114. An opposite spike in developer roller current 412' also follows from that reduction in resistivity between the cleaner roller 120 and developer roller 114. In contrast to the currents shown in FIG. 3, there is no substantive current beyond the point in time 420 at which the voltages are stepped down to the shut-off voltages.

Figure 4C:
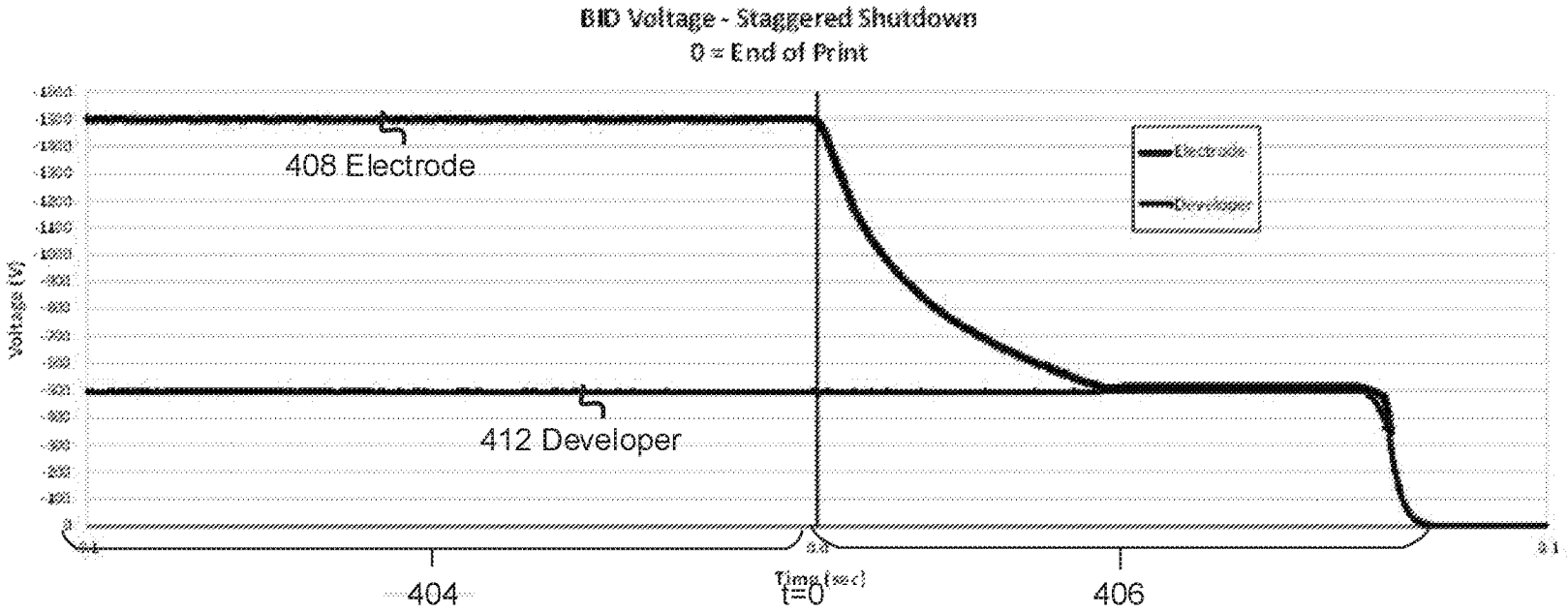

FIG. 4C shows a view 400C of BID voltages according an example implementation. A plurality of voltages is shown. The voltages of the plurality of voltages are shown as varying relative to one another in a temporally offset manner. Varying the plurality of voltages in such a temporally offset manner influences ink movement according to the potential difference between the voltages. In the example implementation, the voltages comprise the electrode voltage 408 and the developer roller voltage 412, as described above with reference to FIG. 4A. Although not shown, an example implementation can also include the cleaner roller voltage 414 shown in or described with reference to FIG. 4A. The electrode voltage 408 has a profile corresponding to that described above with reference to FIG. 4A, as does the developer roller voltage 412.

Figure 4D:
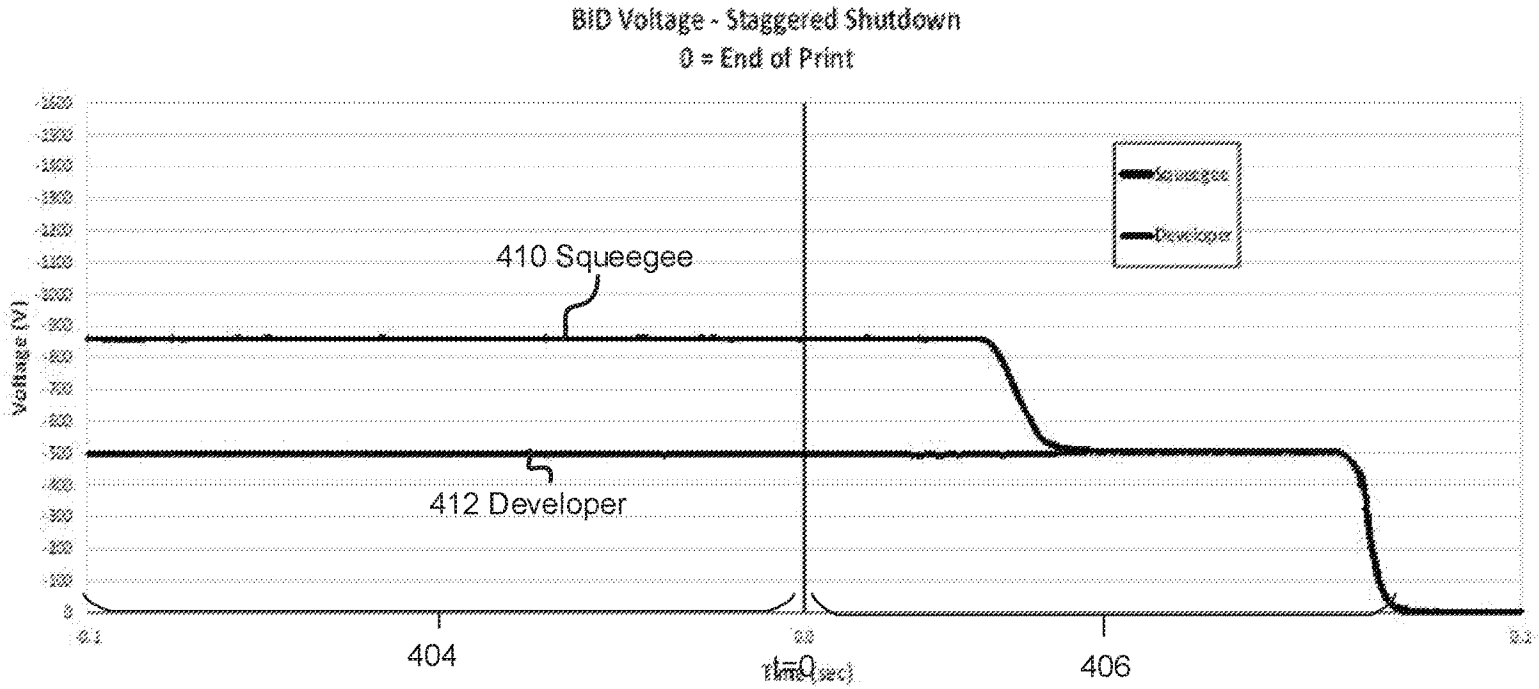

FIG. 4D shows a view 400D of BID voltages according an example implementation. A plurality of voltages is shown. The voltages of the plurality of voltages are shown as varying relative to one another in a temporally offset manner. Varying the plurality of voltages in such a temporally offset manner influences ink movement according to the potential difference between the voltages. In the example implementation, the voltages comprise the squeegee roller voltage 410 and the developer roller voltage 412, as described above with reference to FIG. 4A. Although not shown, an example implementation can also include the cleaner roller voltage 414 shown in or described with reference to FIG. 4A. The squeegee roller voltage 410 has a profile corresponding to that described above with reference to FIG. 4A, as does the developer roller voltage 412.

Figure 4E:
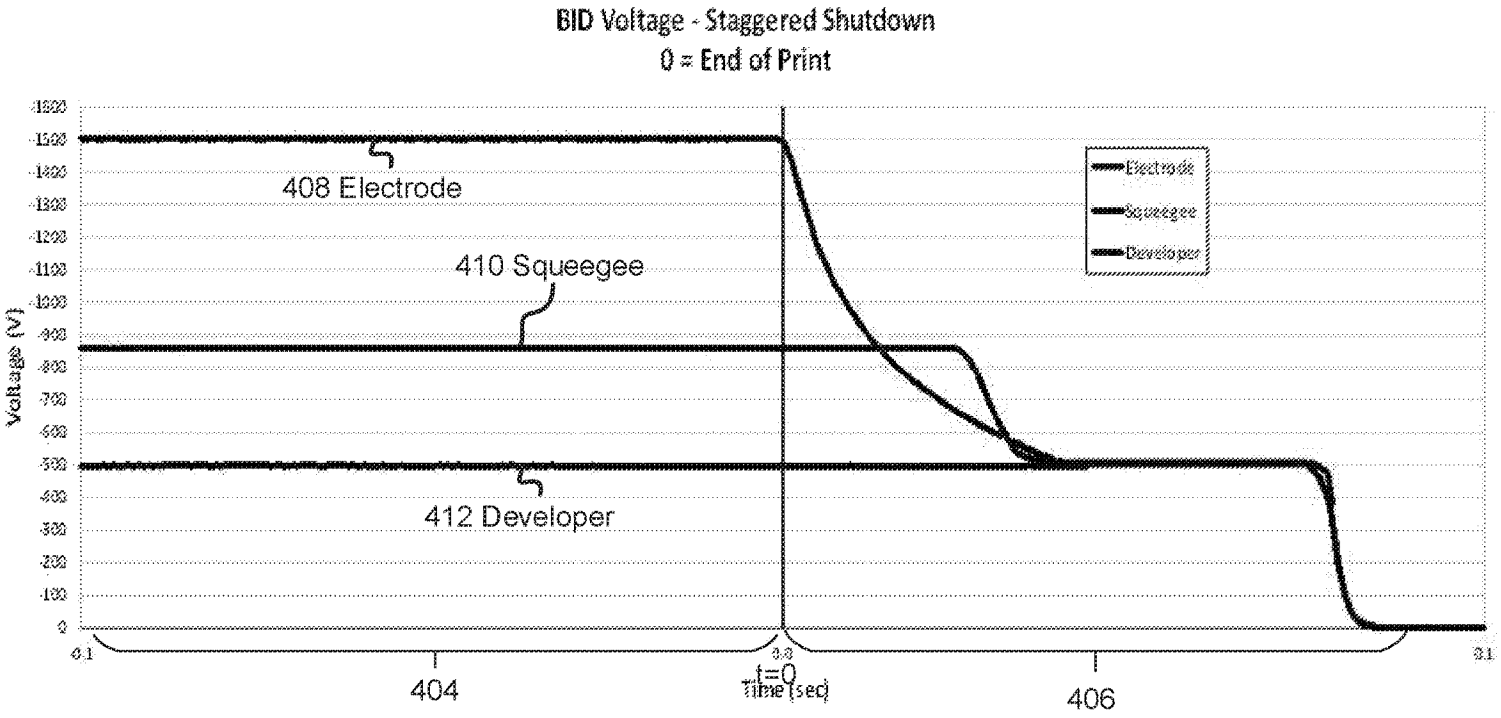

FIG. 4E shows a view 400E of BID voltages according an example implementation. A plurality of voltages is shown. The voltages of the plurality of voltages are shown as varying relative to one another in a temporally offset manner. Varying the plurality of voltages in such a temporally offset manner influences ink movement according to the potential difference between the voltages. In the example implementation, the voltages comprise the electrode voltage 408, the squeegee roller voltage 410 and the developer roller voltage 412, as described above with reference to FIG. 4A. Although not shown, an example implementation can also include the cleaner roller voltage 414 shown in or described with reference to FIG. 4A. The electrode voltage 408 and squeegee roller voltage 410 have respective profiles corresponding to that described above with reference to FIG. 4A, as does the developer roller voltage 412.

Figure 5:
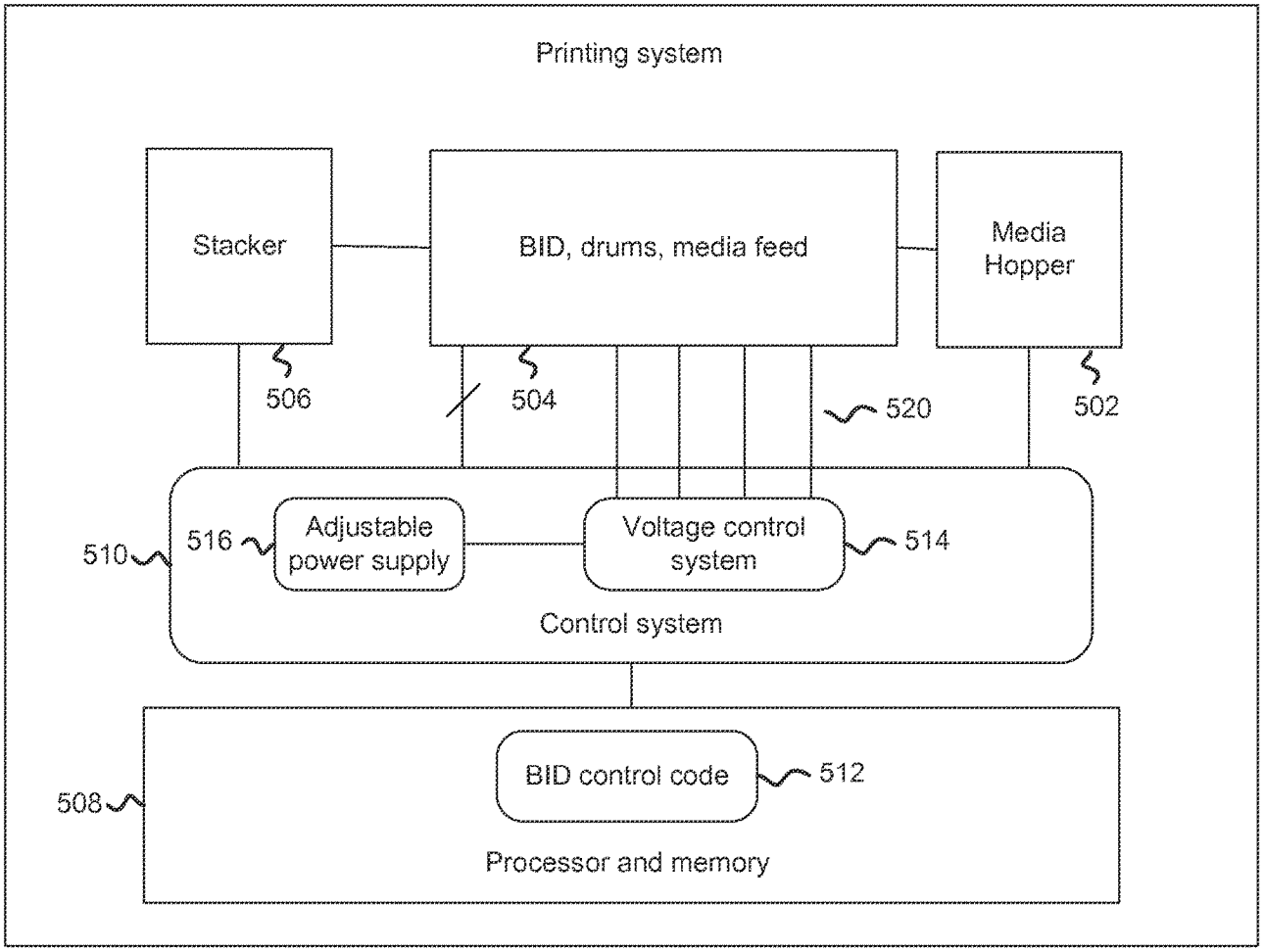
FIG. 5 illustrates a printing device according to an example implementation.

FIG. 5 shows a view 500 of a printing device according to an example implementation that uses the above voltage profiles during the cleaning phase 406 of BID 104 operation. The printing device 500 can be, for example, an Indigo printer available from Hewlett Packard Company. A printer is an embodiment of a printing device.

The printing device 500 comprises a hopper 502 for holding print media. There are also shown BID, drums or rollers and media feed mechanisms 504 for effecting printing and a stacker 506 for holding printed media. The printing device 500 also comprises a processor 508 configured to control the operations of the device. The processor 508 is arranged to control a control system 510 for influencing the voltages used during BID operations, including at least one of printing and cleaning operations. The processor 508 is arranged to execute BID control code 512 for controlling the operation of a voltage control system 514. The voltage control system 514 is configured to output the plurality of voltages for influencing the operation of the BID such as, for example, one or more than one of the developer roller voltage, the primary electrode voltage, the secondary electrode voltage, the squeegee roller voltage, the cleaner roller voltage and the PIP voltage taken jointly and severally in any and all permutations. The voltage control system 514 can be configured to be responsive to power supply 516 such as, for example, an adjustable power supply 516. The plurality of voltages is supplied, via respective supply lines 520, to BID 104.

The control code 512, when executed, can orchestrate or otherwise control the operation of the printing device, including controlling the voltages 408 to 414 applied to the BID during at least one of the preparation phase, printing phase and cleaning phase, taken jointly and severally in any and all permutations.

Figure 6:
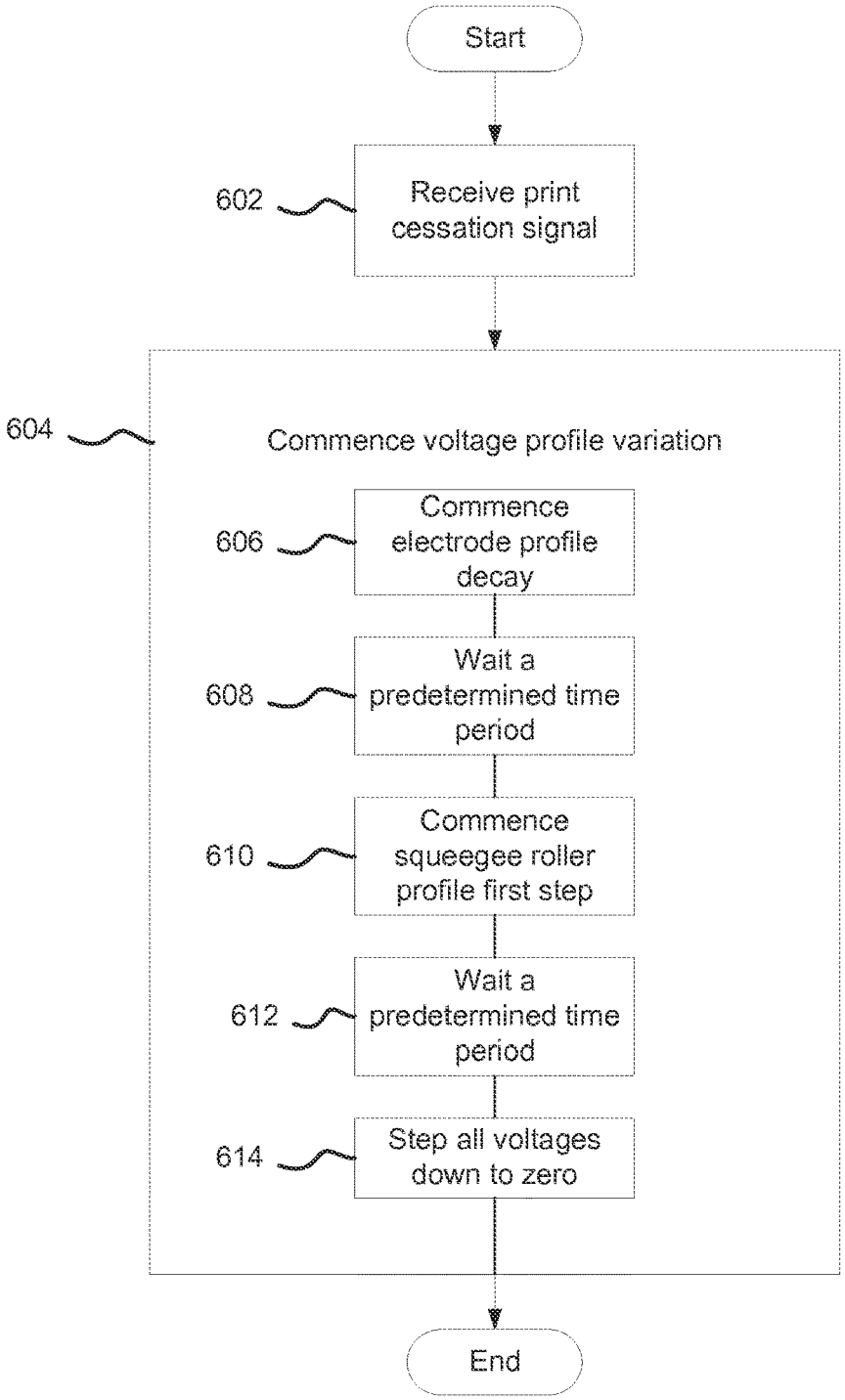
FIG. 6 depicts a flow chart of operations according to an example implementation.

FIG. 6 shows a flow chart 600 of operations following cessation of printing to give effect to the voltage variation profiles according to example implementations. A signal indicating that printing has finished is detected at 602. Voltage decreases are implemented at 604 starting with a progressive decay in the electrode voltage to a level substantially matching, within a predetermined margin, or sufficiently near to the developer roller voltage at 606 to influence such as, prevent development of ink to the electrode. At 608, a predetermined period of time is waited, after which the squeegee roller voltage profile is implemented to change the squeegee roller voltage to substantially match, within a predetermined margin, the developer roller voltage at 610 or to be sufficiently proximate to the developer roller voltage to influence such as, prevent, development of ink to the squeegee roller. The predetermined period of time can be at least 20 to 25 ms, or some other period of time. The predetermined margin can be, for example, −15V.

At 612, a further predetermined period of time is waited before all voltages are stepped down from their present or intermediate values, to their final values. Their final values can be zero volts. The predetermined period of time can be 80 ms from the signal indicating cessation of printing, or some other time period.

Therefore, example implementations are provided in which all ink has been electrostatically removed from the developer roller such that there is no developed ink on the developer roller. The improved cleaning follows from having an electrostatic cleaning phase 406 during which the electrode and roller voltages are varied according to respective voltage profiles, in contrast to there being simply a temporally concurrent single step down to zero volts for all voltages, which results in unused developed ink remaining on developer roller.

Example implementations have been described with reference to cleaning a given ink developer. It will be noted that printing can comprise a multi-colour process that uses a plurality of ink developers. Therefore, example implementations can be realised in which one ink developer of a plurality of ink developers process has been disengaged following printing that is followed by another ink developer of the plurality of ink developers being engaged for printing with the cleaning phase of the disengaged ink developer running in parallel with at least one of the preparation and printing phase of the engaged ink developer. Therefore, the electrostatic cleaning of the disengaged ink developer according to any and all example implementations temporally overlaps with the preparation phase, or printing phase or both the preparation and printing phases of the subsequently engaged ink developer.

Example implementations of the present disclosure can be realised in the form of, or using, hardware, software or a combination of hardware and software. The hardware can comprise at least one of a processor and electronics. The foregoing, that is, the hardware, software or a combination of hardware and software, are embodiments of circuitry. The circuitry can be configured or arranged to perform a respective purpose such as, for example, implementing any and all of the example implementations described in this specification. Any such software may be stored in the form of executable code on volatile or non-volatile storage such as, for example, a storage device like a ROM, whether erasable or rewritable or not, or in the form of memory such as, for example, RAM, memory chips, device or integrated circuits or machine readable storage such as, for example, DVD, memory stick or solid state medium. Storage devices and storage media are example implementations of non-transitory machine-readable storage that are suitable for storing a program or programs, that is, executable code, comprising instructions arranged, when executed, realise example implementations described and claimed herein. Accordingly, example implementations provide machine executable code for realising a system, device, method or for orchestrating a method, developer, system or device operation as described in this specification or as claimed in this specification and machine readable storage storing such code. Still further, such programs or code may be conveyed electronically via any medium such as a communication signal carried over a wired or wireless connection and example implementations suitably encompass the same.

Example implementations have been described with reference to a binary ink developer. Example implementations are not limited to a binary ink developer. Example implementations can be realised according to other developers in addition to or as alternatives to binary ink developers.

Referring to FIG. 6, there is shown a method of controlling an ink developer 104; the ink developer 104 comprising a plurality of members operable in response to a plurality of voltages to influence forming an image. The method comprises, following cessation of printing, varying at least one voltage of the plurality of voltages in a temporally offset manner relative at least one other voltage of the plurality of voltages to influence ink movement associated with at least one member of said plurality of members.

For example, the method comprises varying, at 606, the electrode voltage 408, associated with an electrode 110 and 112 of the ink developer 104, of the plurality of voltages. The variation of the electrode voltage can comprise varying the electrode voltage according to a respective predeterminable voltage profile. The variation can comprise reducing the potential difference between the electrode voltage and at least one voltage of the plurality of voltages such as, for example, reducing the potential difference between the electrode voltage and the developer roller voltage 408 associated with the developer roller 114 of the ink developer 104.

Figure 7:
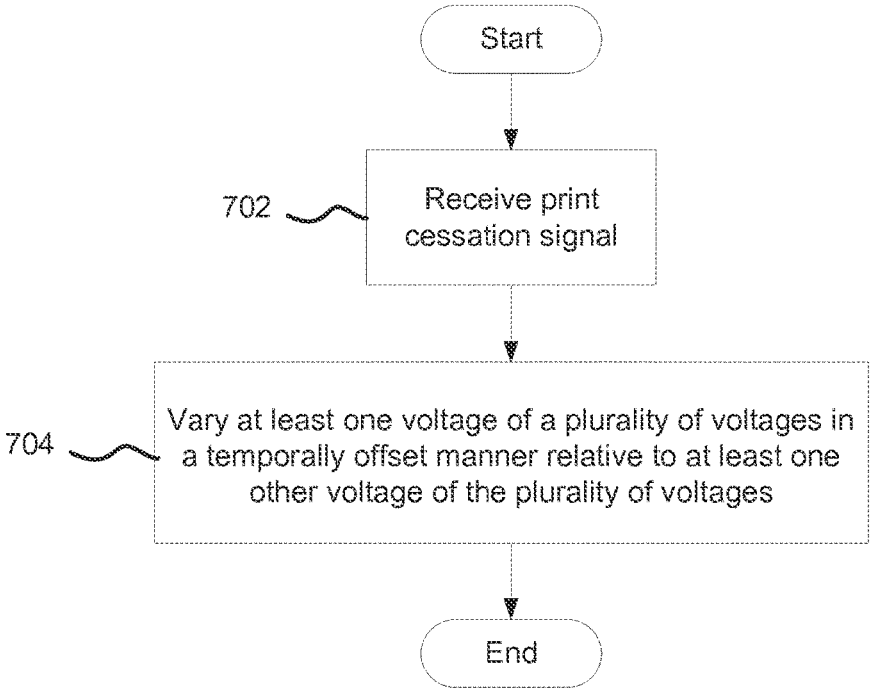
FIG. 7 depicts a flow chart of operations according to another example implementation.

The example implementations of the method shown in or described with reference to FIG. 6 can be varied according to the number of voltages used. As indicated in FIGS. 4C to 4E, the numbers of voltages used can vary. Suitably, FIG. 7 shows a flowchart 700 of an example implementation in which, following detecting of a print cessation condition, at 702, one of the plurality of voltages associated with controlling an ink developer is varied, at 704, in a temporally offset manner relative to at least one other voltage of the plurality of voltages. Example implementations can provide a printer or printing device operable according to any of the methods described or shown in this specification.

Additionally, example implementations can be provided wherein said varying at least one voltage of the plurality of voltages comprises varying, at 610, the squeegee roller voltage 410, associated with the squeegee roller 116 of the ink developer 104, of the plurality of voltages 408 to 414. For example, the squeegee voltage can be varied according to a respective predeterminable voltage profile. Example implementations can be provided in which the predeterminable voltage profile comprises a multi-step profile. The predeterminable voltage profile can comprise a plateau 416 associated with a respective plateau voltage such as, for example, a plateau voltage that substantially equals one other voltage of the plurality of voltages. Example implementations are provided in which the plateau 416 voltage substantially equals the developer roller voltage 412 of the plurality of voltages; the developer roller voltage 412 being associated with the developer roller 114 of the ink developer 104.

Example implementations, additionally or alternatively, provide a method as described in this specification in varying the squeegee voltage 410 comprises reducing the potential difference between the squeegee voltage 410 and at least one voltage of the plurality of voltages such as, for example, the developer roller 412 voltage associated with the developer roller 114 of the ink developer 104.

Alternatively, or additionally, example implementations provide a method of operating an ink developer 104 comprising, following cessation of printing, in response to, for example, a print cessation signal received at 602, preventing ink movement onto the developer roller 114 by varying a potential difference between a source of ink and the developer roller 114; and electrostatically removing the ink from the developer roller.

The method can further comprise transferring ink to the developer roller by maintaining a potential difference between the developer roller 114 and the squeegee roller 116. FIG. 4 shows that any such preventing and transferring are in a temporally overlapping relationship, as a consequence of temporally disparate transitions in the various voltages, in particular, the electrode voltage 408 and the squeegee roller voltage 410.

Example implementations provide a method of controlling the ink developer 104 in which the ink developer comprises a plurality of members such as, for example, electrodes, developer roller, squeegee roller, cleaner roller, that are controllable via a plurality of respective voltages 408 to 414. The plurality of members can comprise at least the developer roller 114, responsive to the developer roller voltage 408, to influence ink transfer to an image forming member, and at least one source of influencing ink movement to the developer roller. The source can comprise, for example, an electrode or squeegee roller providing unintentional transfer of ink from the squeegee roller. The at least one source can be responsive to a respective source voltage of the plurality of voltages 408 to 414 to influence the ink movement to the developer roller. Following cessation of printing an image, example implementations varying the potential difference between the source voltage and the developer roller to influence ink movement to the developer roller.

In the method, the variation can comprise reducing the potential difference between the developer roller voltage and the source voltage to prevent ink movement associated with the at least one source to the developer roller.

Example implementations can, additionally, or alternatively provide a method in which the variation comprising maintaining a potential difference between the source voltage and the developer roller voltage 412 to influence unused ink movement to the developer roller 104.

By reducing the potential difference between the developer roller voltage 412 and the source voltage to prevent ink movement associated with the source to the developer roller while concurrently maintaining a potential difference between a further voltage and the developer roller voltage example implementations can transfer unused ink from the developer roller. Such an example implementation can prevent ink development to the developer roller while encouraging transfer from the developer roller to the cleaner roller.

Example implementations can provide a method of controlling an ink developer such as, for example, the ink developer 104. The ink developer can comprise a developer roller 114, responsive to a developer roller voltage 412, and a plurality of further members responsive to respective further voltages such as, for example, a squeegee roller 116, cleaner roller 120 and electrode 110/112. The method can comprise, following cessation of printing, progressively varying the further voltages relative to the developer roller voltage to influence ink movement associated with the developer roller.

The variation can comprise reducing the potential difference between the developer roller voltage 412 and the source voltage to influence ink movement associated with source to the developer roller 114. For example, the potential difference between the developer roller voltage and the source voltage can be reduced so that the source voltage matches or substantially matches the developer roller voltage. This can be achieved by, for example, decreasing the source voltage so that the source voltage matches or substantially matches the developer roller voltage 412.

As indicated, the further members can comprise at least one electrode, such as one or more of the primary and secondary electrodes 110 and 112, for influencing ink movement to the developer roller 114 and the source voltage is associated with the at least one electrode.

Example implementations can, additionally or alternatively, provide such method as described in this specification that additionally or alternatively maintains a potential difference between source voltage and the developer roller voltage 412 to influence unused ink movement to the developer roller. Furthermore, any such maintaining of a potential difference between a source voltage and the developer roller voltage 412 to influence unused ink movement to the developer roller can be followed by reducing the potential difference between the developer roller voltage 412 and the source voltage so that the source voltage matches or substantially matches the developer roller voltage.

Example implementations are provided in which such varying, in any and all methods above, can comprise reducing the potential difference between the developer roller voltage and the source voltage to prevent transfer of ink from the source to the developer roller while concurrently maintaining a potential difference between a further source voltage and the developer roller voltage to transfer unused ink from developer roller to a member associated with the further source voltage.

Referring to FIG. 4A, example implementations can provide a method of controlling an ink developer 104 that comprises a developer roller 114, responsive to a developer roller voltage 412, and a plurality of further members responsive to respective further voltages; the method can comprise, following cessation of printing, sequentially varying the further voltages and, or relative to, the developer voltage to influence ink movement associated with the developer roller. Example implementations are provided in which the sequentially varying can comprise varying the further voltages and the developer roller voltage 412 at temporally disparate times. For example, any such sequentially varying can comprise temporally disparately varying the further voltage and developer voltage.

Example implementations can provide a method of electrostatically removing ink from a developer roller 114 of an ink developer 104; the latter comprising the developer roller 114 and a plurality of members in which the roller and members are operable in response to a plurality of voltages to influence forming an image; the method can comprise controlling the ink developer according to any and all methods described in this specification taken jointly and severally.

Referring to FIG. 4 again, example implementations can provide a method of controlling an ink developer 104, which can comprise at least an electrode 110 and 112 and a developer roller 114; that, during printing, operates the electrode 110 or 112 at a respective electrode voltage 408 and operates the developer roller 114 at a respective developer roller voltage 412, and, following cessation of printing, varies the potential difference between the electrode 110 and 112 and the developer roller 114 by, for example, reducing the potential difference between the electrode and the developer roller to stop ink movement to the developer roller. For example, reducing the potential difference between the electrode and the developer roller can comprise reducing the electrode voltage relative to the developer roller voltage. For example, the electrode voltage can be reduced to match the developer roller voltage.

An example, implementation of such as method can further comprise maintaining a squeegee roller voltage 410 of a squeegee roller 116 of the ink developer 104 at a respective voltage during printing for a predetermined period of time after cessation of printing as illustrated in FIG. 4A. For example, any such maintaining can comprise maintaining the squeegee roller voltage 410 at the respective voltage until the electrode voltage 408 has reduced to a level that is less than the squeegee roller voltage 410.

Thereafter, the squeegee roller voltage can be further reduced to decrease the potential difference between the squeegee roller voltage 410 and the developer roller voltage 412. For example, any such further reduction can comprise decreasing the squeegee roller voltage 410 so that it matches the developer roller voltage 412. The developer roller voltage can then be reduced to a final value following at least the electrode voltage having been reduced to match the developer roller voltage. The final value can be 0v.

Thereafter, at least the electrode voltage can be reduced to 0v. Reducing at least the electrode voltage to zero can comprise reducing the electrode voltage to zero substantially concurrently with reducing the developer roller voltage to zero.

Thereafter, the method can comprise disengaging the ink developer 104 after varying the potential difference between the electrode 110 and 112 and the developer roller 114.

In broad terms, example implementations can provide a method of controlling an ink developer such as, for example, the above ink developer 104, in which, following cessation of printing, a plurality of voltages associated with movement of ink within the ink developer are varied at temporally disparate times. Any such variation at temporally disparate time can comprise decreasing at least one voltage of the plurality of voltages to a non-zero voltage. Decreasing at least one voltage of the plurality of voltage to a non-zero voltage can influence ink development.

For example, any such said varying of the plurality of voltages associated with movement of ink within the ink developer can comprise reducing the potential difference between a primary electrode of the ink developer and a developer roller of the ink developer. The developer roller can bear a respective non-zero voltage during any such varying.

Example implementations can be realised in which any such varying of the plurality of voltages associated with movement of ink within the ink developer at temporally disparate times can comprise varying a squeegee roller voltage of a squeegee roller of the ink developer according to a predetermined profile. The predetermined profile can comprise a stepped profile comprising a plurality of non-zero voltage levels.

Any and all of the methods described or claimed in this specification can used to control a printing device comprising a binary ink developer. Therefore, example, implementations provide a controller to implement the methods described in this specification.

Varying, or otherwise managing, the relative voltages of the various elements of an ink developer in a time varying manner, or Example implementations can provide a printing device such as, for example, the device shown in or described with reference to FIG. 5. The printing device 500 can comprise a controller, circuitry or processor to control at least one ink developer 104 according to any method as described or claimed herein. Similarly, example implementations can provide a controller, circuitry or processor for controlling an ink developer or such a printing device; the controller comprising circuitry or a processor to orchestrate or implement any method as described or claimed herein. Furthermore, any such methods can be realised, at least in part, using machine executable code comprising instructions arranged, when executed by at least one processor, to control or implement any method described or claimed herein. Example, implementations provide non-transitory machine readable storage storing such machine executable code.

The invention claimed is:

1. A printer for printing to a substrate; the printer comprising an ink developer; the ink developer comprising a plurality of members operable in response to a plurality of voltages to influence forming an image; the printer comprising circuitry, responsive to cessation of printing, to vary at least one voltage of the plurality of voltages in a temporally offset manner relative to at least one other voltage of the plurality of voltages to influence ink movement associated with at least one member of said plurality of members, wherein the plurality of members comprises an electrode and said circuitry to vary at least one voltage comprises circuitry to vary an electrode voltage of the electrode by reducing the potential difference between the electrode voltage and at least one voltage of the plurality of voltages.

2. The printer of claim 1, wherein the plurality of members comprises a developer roller and said circuitry to vary the electrode voltage comprises circuitry to reduce the potential difference between the electrode voltage and a developer roller voltage associated with the developer roller of the ink developer.

3. The printer of claim 1, wherein the plurality of members comprises a squeegee roller and said circuitry to vary at least one voltage of the plurality of voltages comprises circuitry to vary a squeegee roller voltage, associated with the squeegee roller of the ink developer.

4. The printer of claim 3, wherein said circuitry to vary a squeegee roller voltage comprises circuitry to vary the squeegee roller voltage according to a predeterminable voltage profile.

5. The printer of claim 4, wherein the predeterminable voltage profile comprises a plateau associated with a respective plateau voltage to influence movement of ink within the ink developer.

6. The printer of claim 3, wherein said circuitry to vary the squeegee voltage comprises circuitry to reduce the potential difference between the squeegee roller voltage and a developer roller voltage associated with a developer roller of the ink developer.

7. The printer of claim 1, further comprising a cleaner roller and circuitry to maintain a cleaner roller voltage of said plurality of voltages relative to said at least one other voltage of the plurality of voltages to influence transfer of ink to the cleaner roller from said at least one member of the plurality of members; wherein said at least one member is a developer roller and said at least one other voltage is a developer roller voltage of the developer roller.

8. A controller for a printing device for printing to a medium; the printing device comprising at least one ink developer; the ink developer comprising a developer roller, responsive to respective developer roller voltage; the controller comprising circuitry to manage at least one other voltage associated with at least one further member of the ink developer relative to the developer roller voltage to influence movement of ink within the ink developer, wherein said at least one member comprises a squeegee roller, having a respective squeegee roller voltage.

9. The controller of claim 8; wherein said at least one member comprises a cleaner roller and said at least one other voltage is an associated cleaner roller voltage.

10. The controller of claim 8, wherein the squeegee roller voltage is managed to have a potential relative to at least one of the developer roller and an electrode of the ink developer to prevent movement of ink to the squeegee roller.

11. Non-transitory machine readable storage storing machine executable code arranged, when executed by at least one processor, to sequentially reduce potential differences between a developer roller voltage of a developer roller of an ink developer and at least one other voltage associated with the ink developer in a staggered manner.

12. The non-transitory machine readable storage of claim 11, further comprising instructions arranged, when executed, to sequentially reduce potential differences between the developer roller voltage of the ink developer and at least one electrode of the ink developer associated with transferring ink to the developer roller.

13. The non-transitory machine readable storage of claim 11, further comprising instructions arranged, when executed, wherein to reduce the potential difference between the developer roller voltage of the ink developer and a squeegee roller of the ink developer according to a predetermined profile.

* * * * *